US005829228A

United States Patent [19]

Mogard

[11] Patent Number: 5,829,228

[45] Date of Patent: Nov. 3, 1998

[54] METHOD AND APPARATUS FOR FORMING THE TOP OF A CONTAINER

[75] Inventor: Jens Mogard, Buffalo Grove, Ill.

[73] Assignee: Tetra Laval Holdings & Finance, SA, Pully, Switzerland

[21] Appl. No.: 922,197

[22] Filed: Sep. 2, 1997

Related U.S. Application Data

[63] Continuation-in-part of Ser. No. 639,162, Apr. 25, 1996, Pat. No. 5,704,541.

[51] Int. Cl.[6] ..... B65B 61/18

[52] U.S. Cl. ..... 53/412; 53/458; 53/467; 53/484; 493/105; 493/165; 493/175; 493/184

[58] Field of Search ..... 53/412, 410, 458, 53/459, 467, 477, 484, 563, 565, 242, 243, 133.2, 575; 493/102, 103, 105, 106, 163, 164, 165, 175, 176, 177, 178, 179, 180, 181, 182, 183, 184, 185, 962

[56] References Cited

U.S. PATENT DOCUMENTS

| | | | |
|---|---|---|---|
| 3,119,543 | 1/1964 | Walker | 53/133.2 |
| 3,789,746 | 2/1974 | Martensson et al. | 53/563 |
| 3,820,303 | 6/1974 | Martensson et al. . | |
| 4,456,118 | 6/1984 | Kauffman et al. | 53/565 |
| 4,604,850 | 8/1986 | Reil | 53/563 |
| 4,738,811 | 4/1988 | Kawajiri et al. | 53/133.2 |
| 4,790,123 | 12/1988 | Ljungstrom et al. | 53/563 |
| 5,058,360 | 10/1991 | Yamazaki et al. | 53/133.2 |
| 5,276,934 | 1/1994 | Pape et al. | 53/133.2 |
| 5,484,374 | 1/1996 | Bachner et al. | 53/133.2 |
| 5,492,592 | 2/1996 | Bergholtz et al. | 53/133.2 |
| 5,716,471 | 2/1998 | Pape | 53/133.2 |

FOREIGN PATENT DOCUMENTS

| | | | |
|---|---|---|---|
| 406001305A | 1/1994 | Japan | 53/133.2 |

*Primary Examiner*—Daniel B. Moon
*Assistant Examiner*—John Paradiso
*Attorney, Agent, or Firm*—Michael A. Catania

[57] ABSTRACT

The present invention forms and seals the top end of a container prior to filling and bottom sealing. The top end may have a fitment attached thereon at a variety of different positions on a form, fill and seal packaging machine. The fitment may be a screw cap, a push-in, a flip-cap type or similar fitments. The container may be a flat top ., tetrahedral or similar type container. The fitment may be applied on the exterior or the interior of the container.

13 Claims, 12 Drawing Sheets

METHOD AND APPARATUS FOR FORMING THE TOP OF A CONTAINER

CROSS REFERENCES TO RELATED APPLICATIONS

This application is a continuation-in-part of U.S. application Ser. No. 08/639,162, U.S. Pat. No. 5,704,541, filed on Apr. 25, 1996.

STATEMENT REGARDING FEDERALLY SPONSORED RESEARCH OR DEVELOPMENT

Not Applicable

BACKGROUND OF THE INVENTION

Field of the Invention

The present invention relates to a method and apparatus for forming the top of a container. Specifically, the present invention relates to a method and apparatus for forming the top of a container on a mandrel wheel of a form, fill and seal packaging machine.

Description of the Related Art

Many varieties of single-use containers exist for the packaging of liquids, powders or the like. The liquids may include milk or juice. The containers may be formed from blanks or sheets made of a variety of laminate materials having a substrate such as paperboard, strawboard, pasteboard, cardboard, and the like. The substrate may be laminated with a thermoplastic or similar liquid resistant coating to enable the container to retain liquids. The blanks may be folded into a variety of container cross-sections, such as tubular, rectangular, square, octagonal, hexagonal, and the like.

Traditionally, milk has been packaged in gable-top cartons which are torn open to reveal an integrated pouring device for accessing the product. Most recently, juice, such as orange juice, packaged in gable-top cartons with a fitment attached for accessing the product has gained favor with the consumer.

However, gable-top cartons have limitations that are dependent upon the circumstances. Gable-top cartons waste an enormous amount of material to form the gable-top which before the advent of fitments, and the technology for applying them, was necessary to access the product. Currently, with the popularity of fitments, the gable-top has become a non-functional aesthetic component of cartons.

Conventional containers have been proposed with flat upper ends having a spout and cap opening in the center of the top. However, flat ended containers experience other limitations. In flat ended containers, the adjoining edges of the folded end panels produce seams. These seams expose edges of the paperboard substrate material to the liquid product within the container. The product undergoes a wicking or capillary action and is soaked into the paperboard core of the container thereby degrading the seals and compromising the integrity of the package. In addition, conventional flat ended containers are unable to achieve a hermetic seal along the seams produced at the upper end of the container. Thus, while conventional flat ended containers are liquid tight, such containers are not hermetically sealed and, therefore, are unable to maintain a pressurized interior chamber, such as is required to preserve carbonated liquids. In addition, the non-hermetic seams in conventional paperboard-based containers are an unsatisfactory medium for storing liquids which are highly sensitive to oxygen, such as wine, orange juice, or the like.

A further problem has been forming containers without a top fin seal most readily apparent on a gable-top carton. For the most part, traditional form, fill and seal carton packaging machines do not lend themselves to high production of non-gable-top cartons. Some machines may flatten and seal the gable-top to provide an appearance of a flat top carton, however, this does not resolve the inefficient use of material.

BRIEF SUMMARY OF THE INVENTION

The present invention resolves the problems of the prior art by providing a novel method and apparatus for forming containers. The present invention accomplishes this by first forming the top end of the container, then filling, and then sealing the bottom end of the container.

One aspect of the present invention is a method for fabricating a container on a packaging machine. The method involves placing an erected container on a mandrel, folding the top panels, heating the top panels and then sealing the top panels together to form the top end of the container. The method may also include applying a fitment to the top end of the container.

Another aspect of the invention is an apparatus for fabricating a container on a packaging machine. The apparatus includes a folding device, a heating device, a pressing device and a discharging means. The various components are disposed about a rotating mandrel wheel having a plurality of mandrels projecting therefrom. The apparatus may also include a means for applying a fitment.

Another aspect of the present invention is a container form by the method of the present invention. The container may have a non-gable top end which could be a number of different styles such as tetrahedral top, flat top, and the like.

It is a primary object of the present invention to provide a method and apparatus for sealing the top of a container prior to filling and sealing of the bottom.

It is an additional object of the present invention to provide a method and apparatus for fabricating a tetrahedral top carton.

It is an additional object of the present invention to provide a method and apparatus for forming a flat top container having a fitment thereon.

It is an additional object of the present invention to provide a method and apparatus for attaching a fitment to a container being fabricated on mandrel wheel.

It is an additional object of the present invention to provide a method and apparatus for forming, filling and sealing a container commencing with the forming and sealing of the top of the container.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a perspective view of the interworkings of a form, fill and seal machine;

Figure 1:
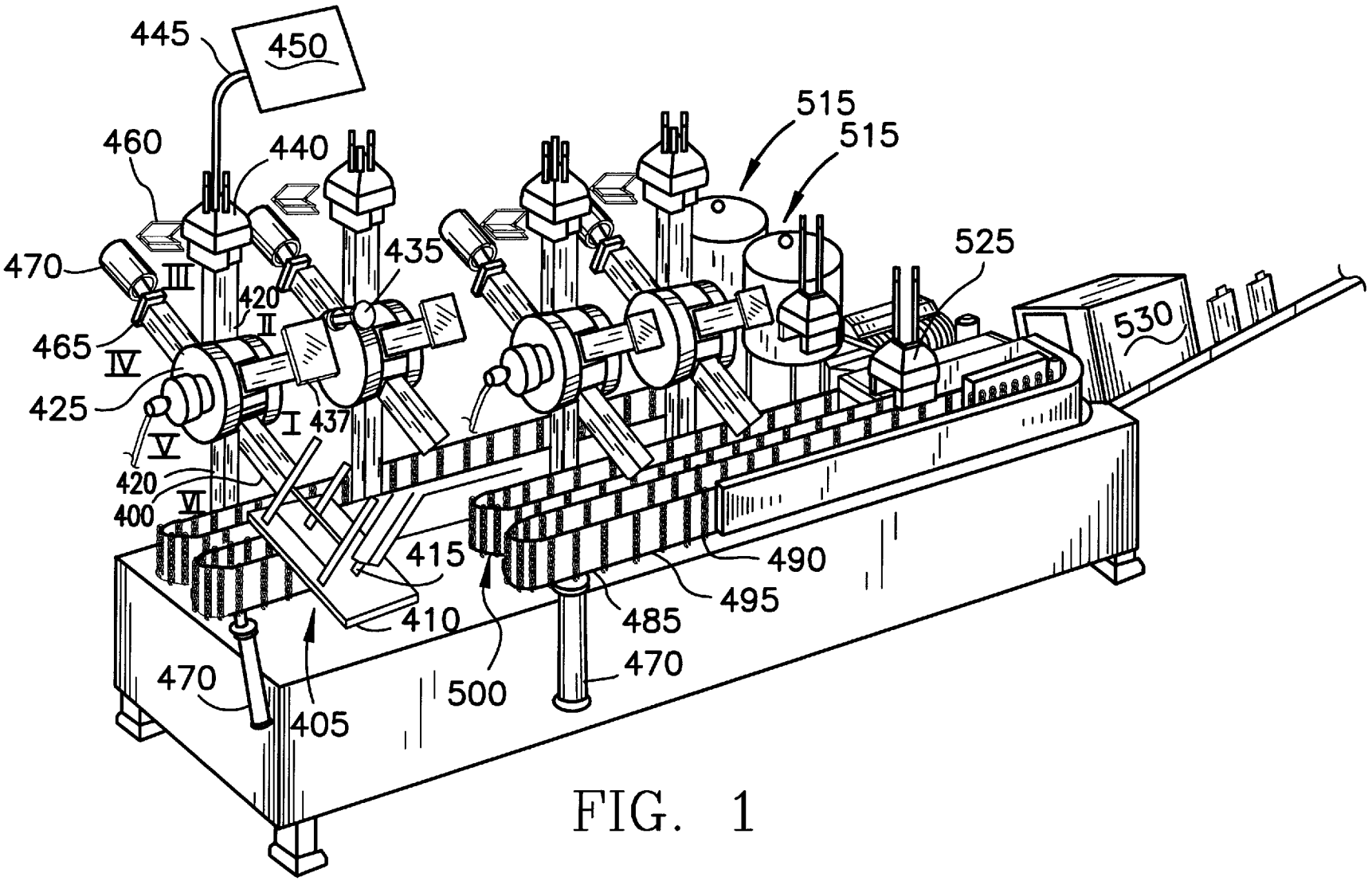
Figure 1A:
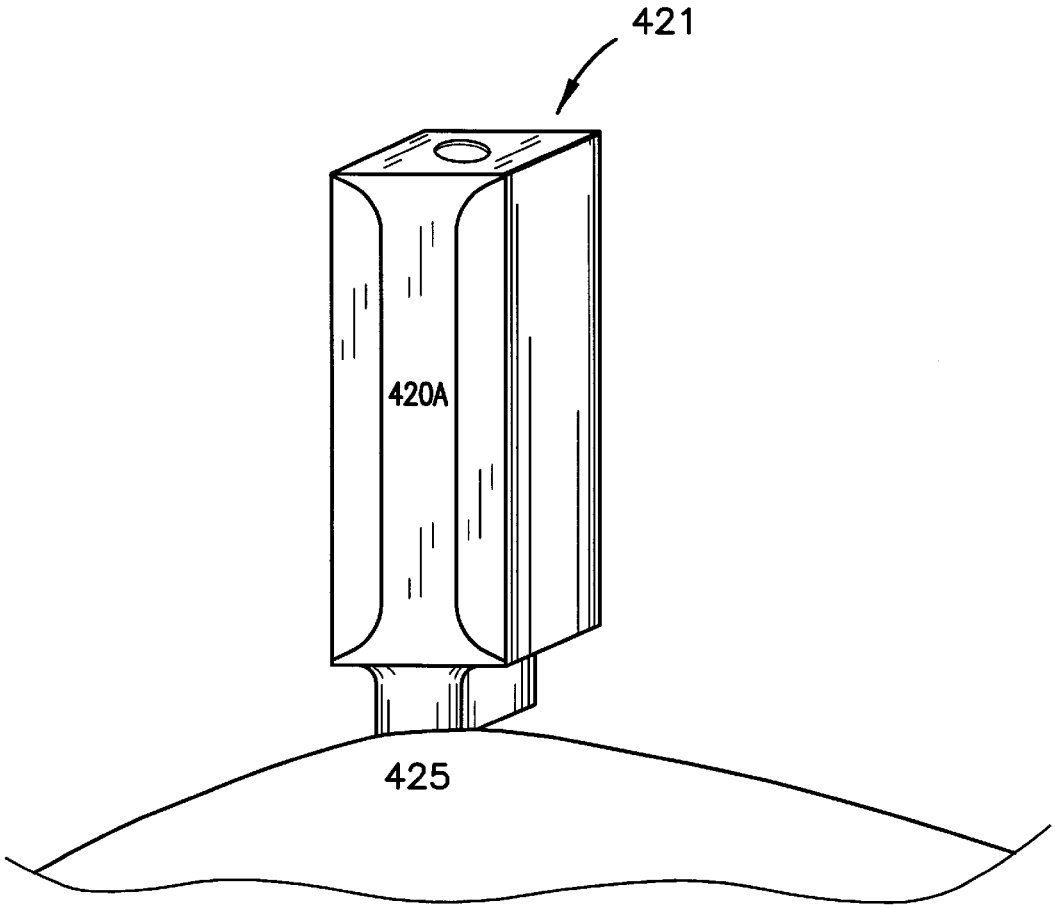
Figure 1B:
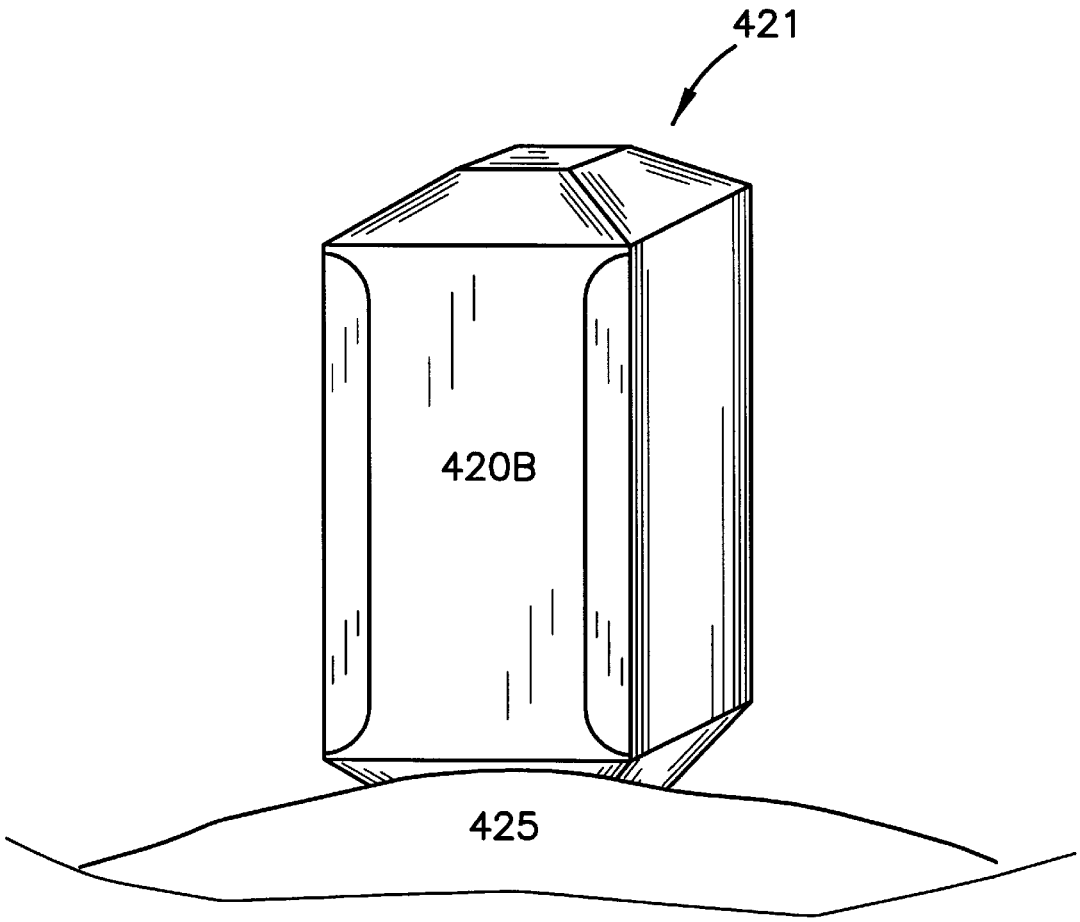
Figure 2A:
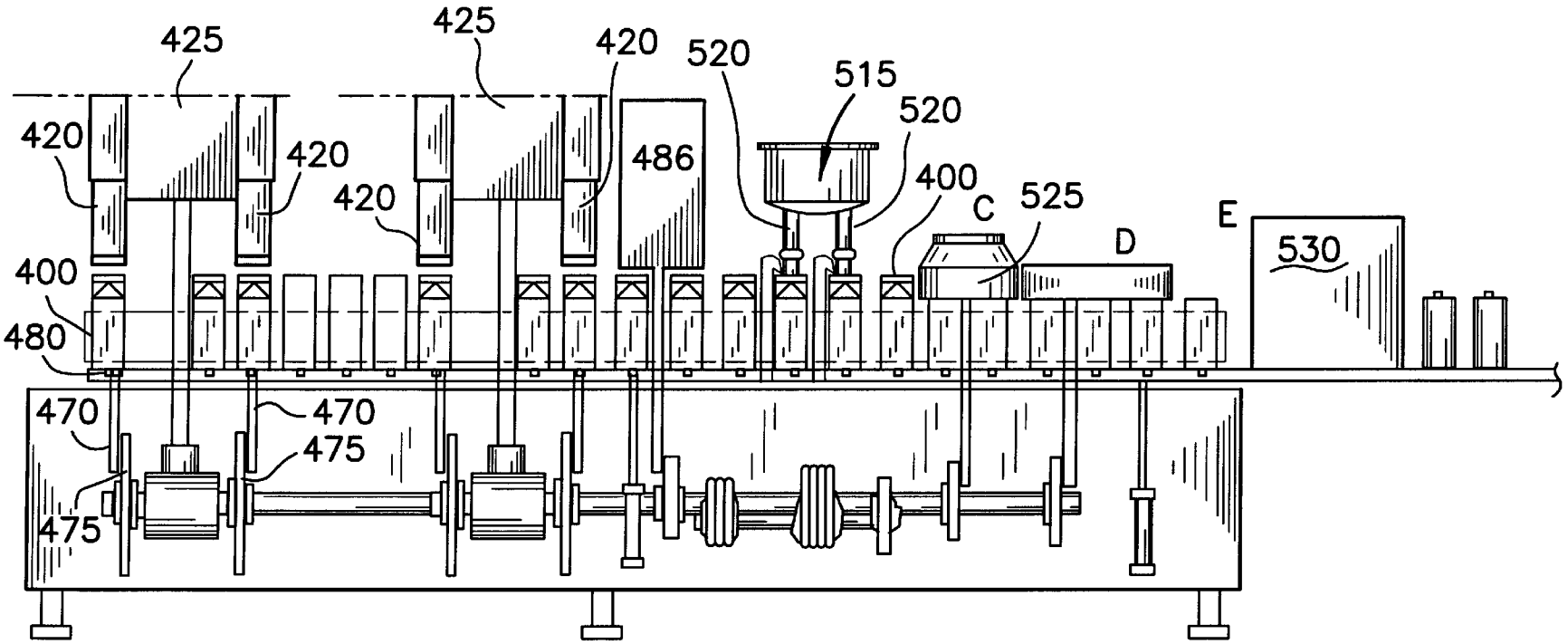
Figure 2B:
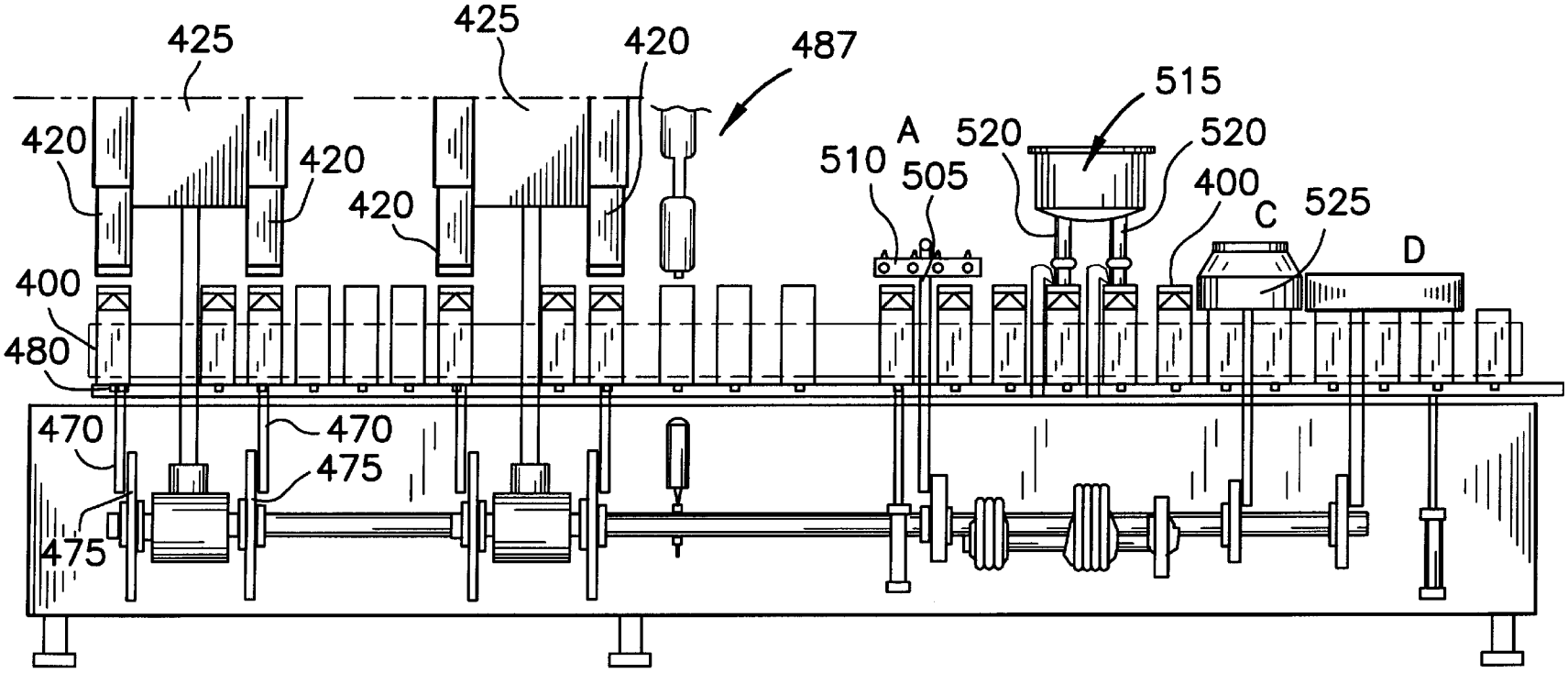
Figure 2C:
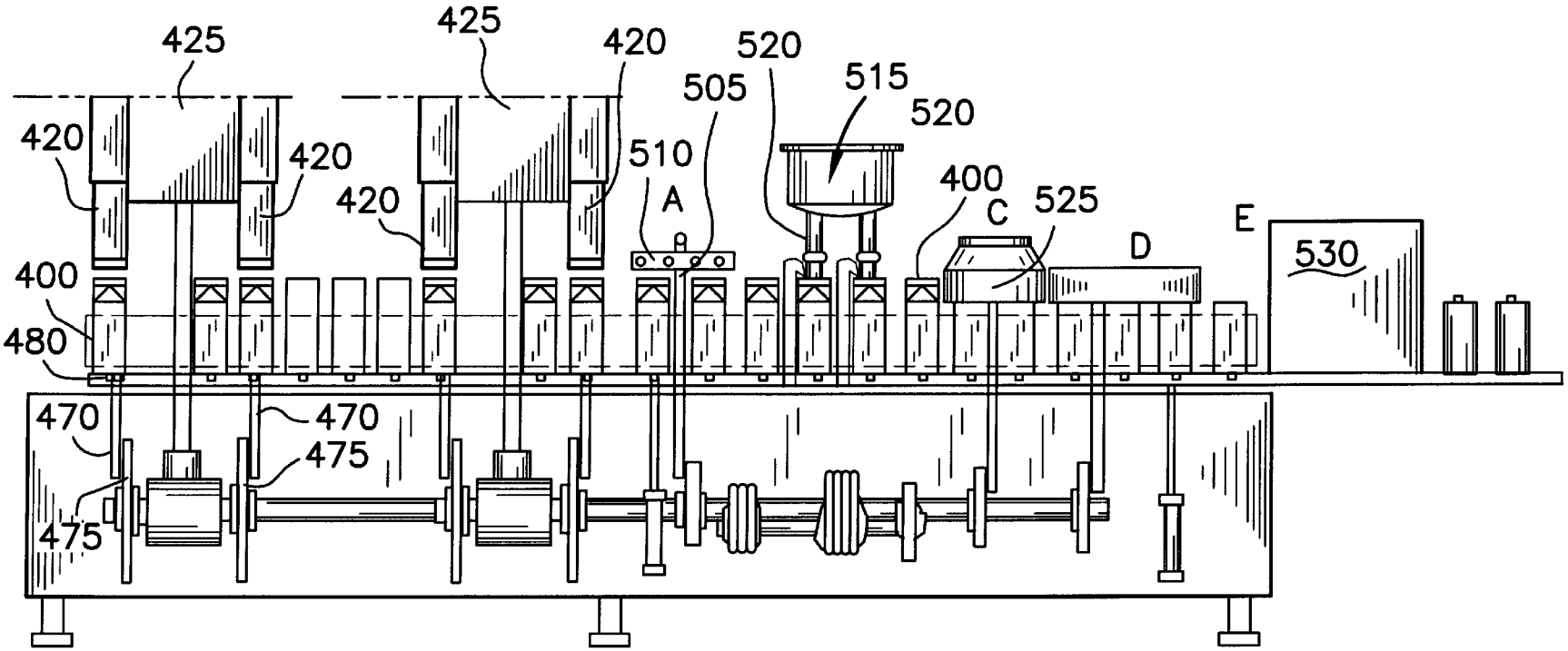
Figure 4:
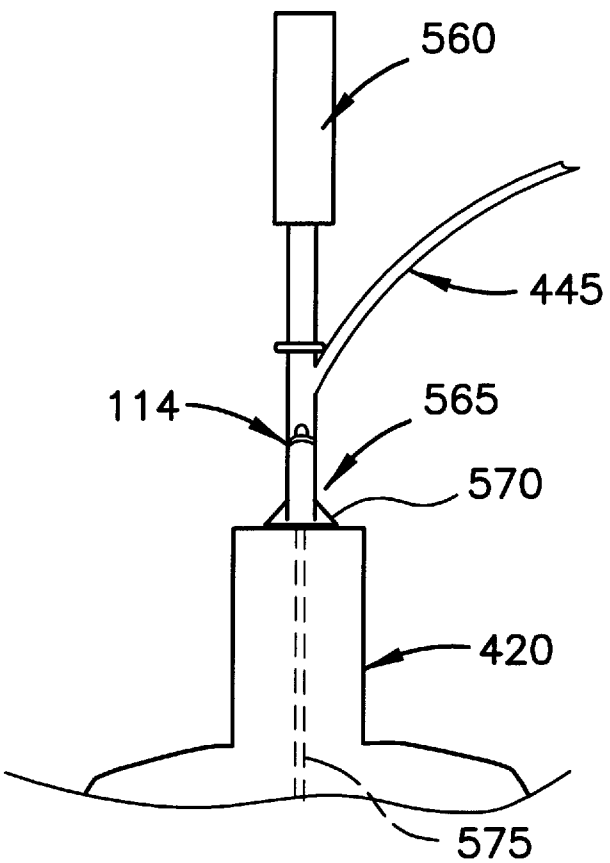
Figure 3:
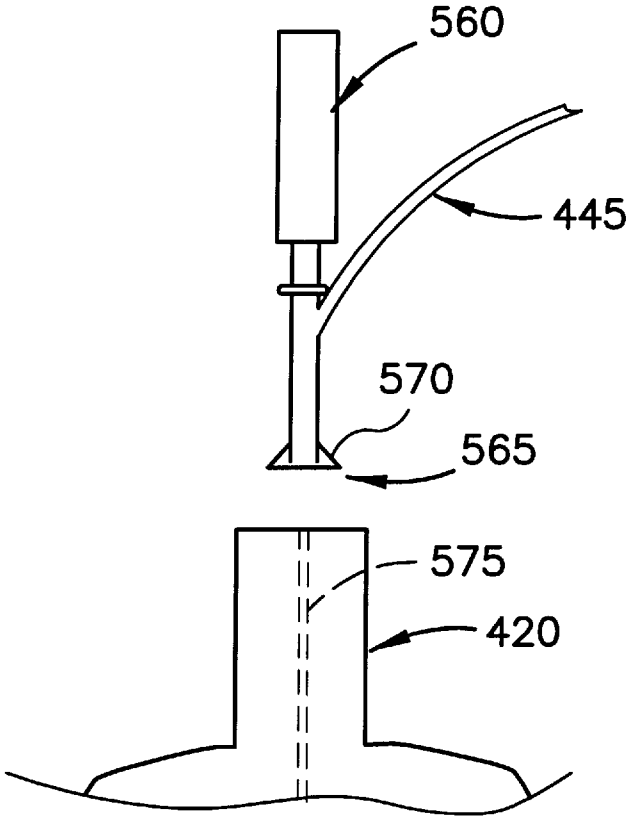
Figure 5:
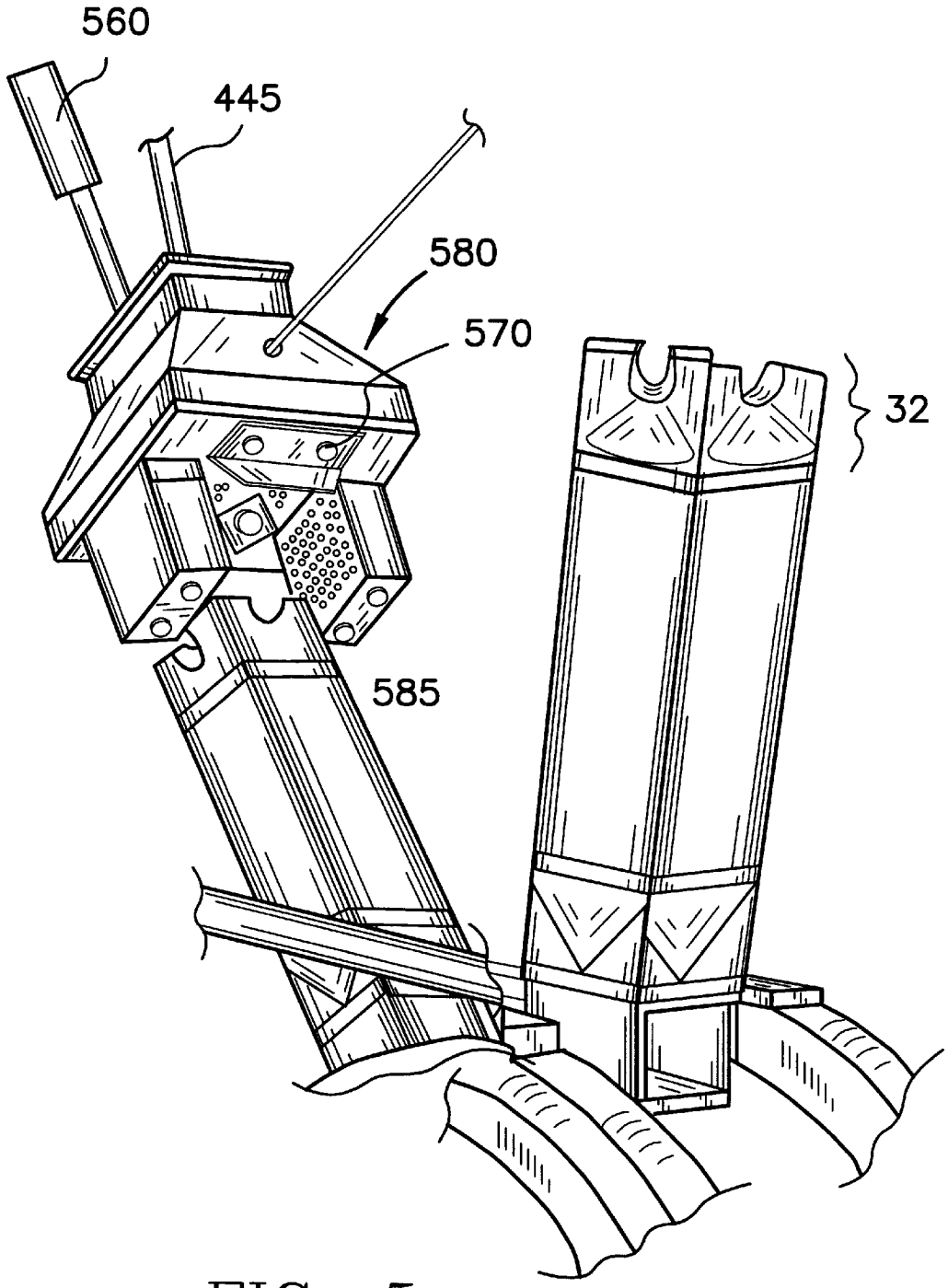
Figure 6:
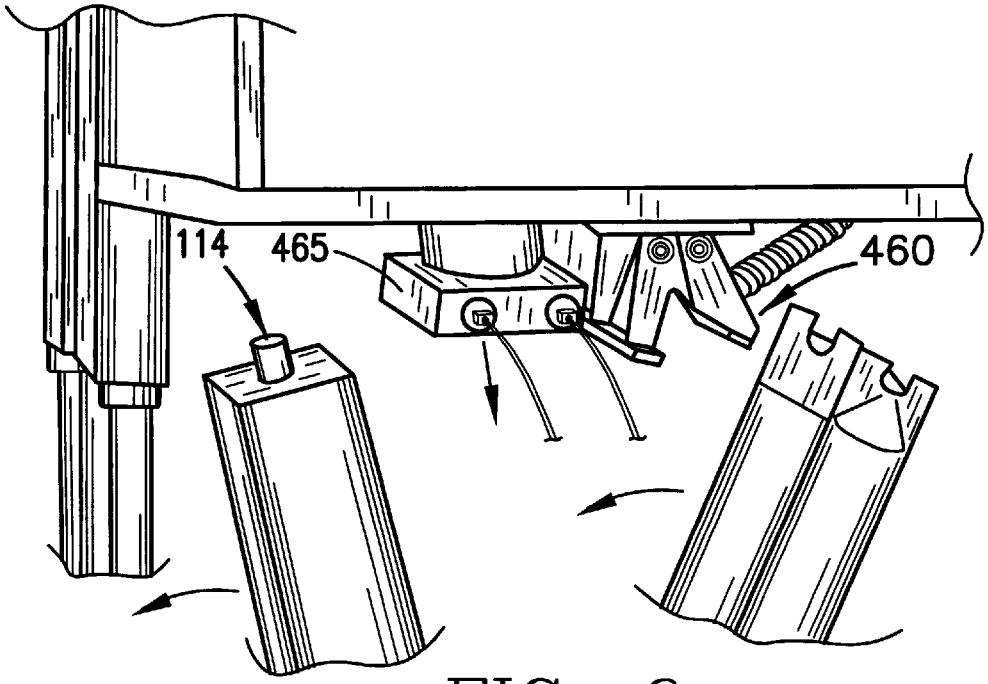
Figure 7:
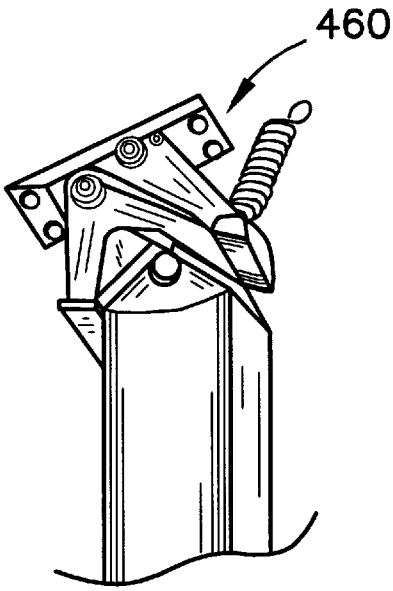
Figure 8:
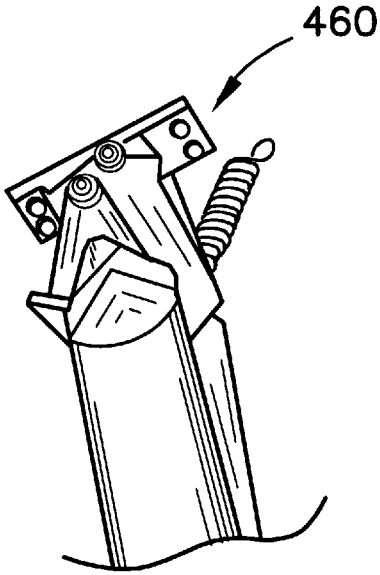
Figure 9:
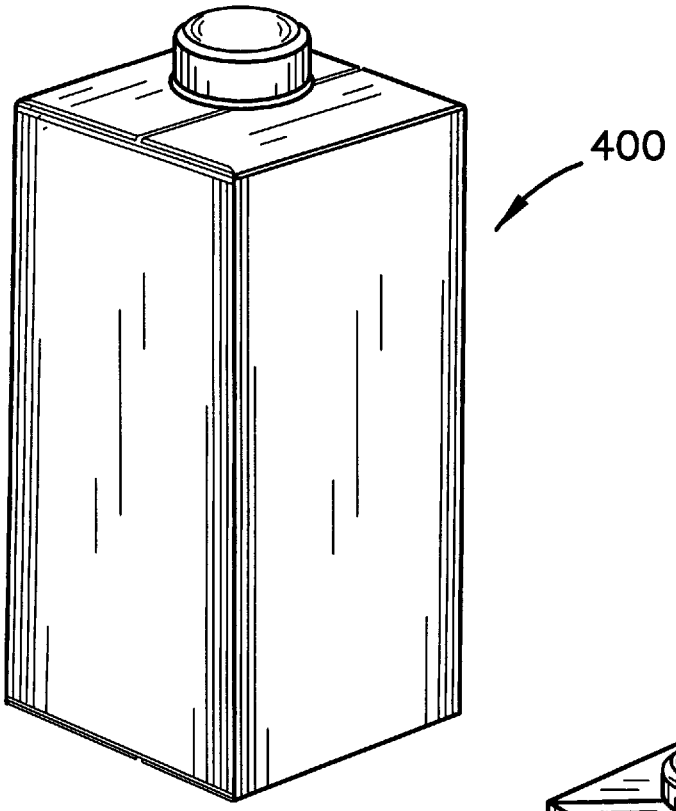

There is illustrated in FIG. 1A a perpsective view of a mandrel of the present invention;

There is illustrated in FIG. 1B a perpsective view of an alternative mandrel of the present invention;

There is illustrated in FIG. 2A a side perspective of a filling machine integrated with the present invention;

There is illustrated in FIG. 2B a side perspective of a filling machine integrated with the present invention;

There is illustrated in FIG. 2C a side perspective of a filling machine integrated with the present invention;

There is illustrated in FIG. 3 a schematic view of a fitment applying station at one point in time;

There is illustrated in FIG. 4 a schematic view of a fitment applying station at a second point in time;

There is illustrated in FIG. 5 a perspective view of the heating station of the present invention;

There is illustrated in FIG. 6 a perspective view of the top sealing station of the present invention;

There is illustrated in FIG. 7 a perspective view of the folding device of the top sealing station at one point in time;

There is illustrated in FIG. 8 a perspective view of the folding device of the top sealing station at a second point in time;

There is illustrated in FIG. 9 a perspective view of a flat top container fabricated from the present invention.

Figure 10:
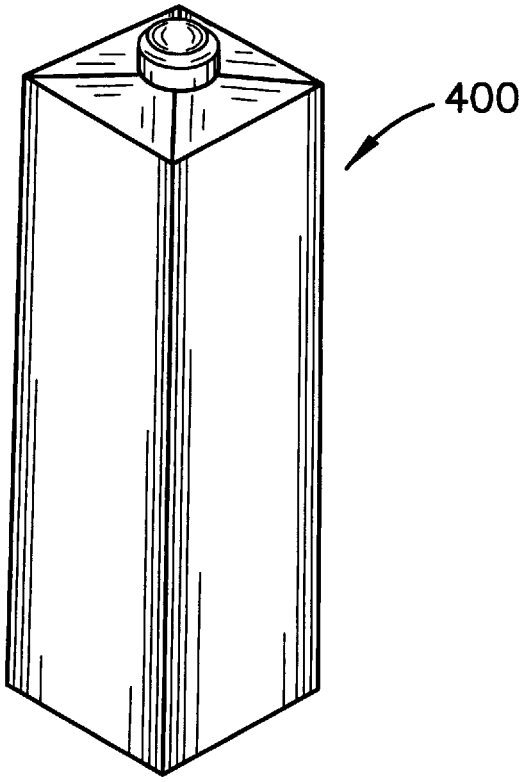

There is illustrated in FIG. 10 a perspective view of a tetrahedral top container fabricated from the present invention.

Figure 11:
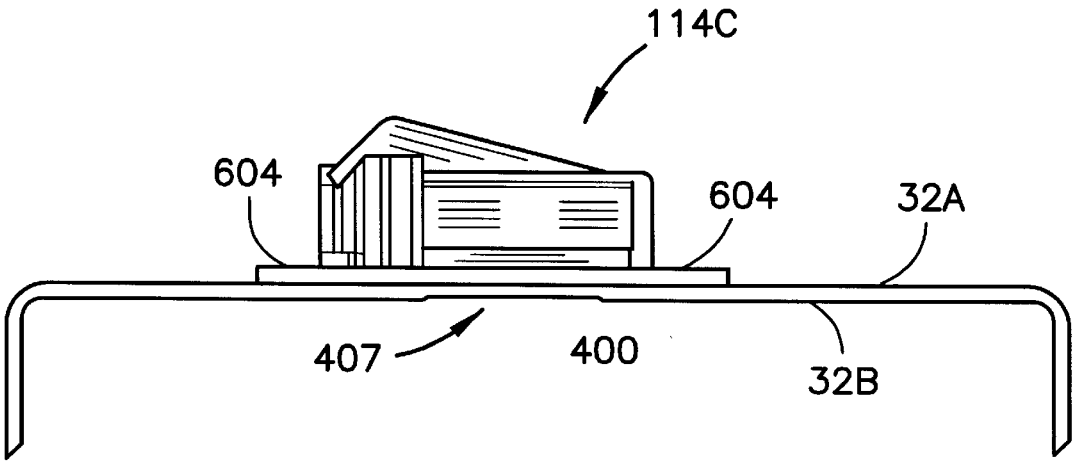

There is illustrated in FIG. 11 a side perspective of a flip cap fitment attached to the exterior surface a container fabricated from the present invention.

Figure 12:
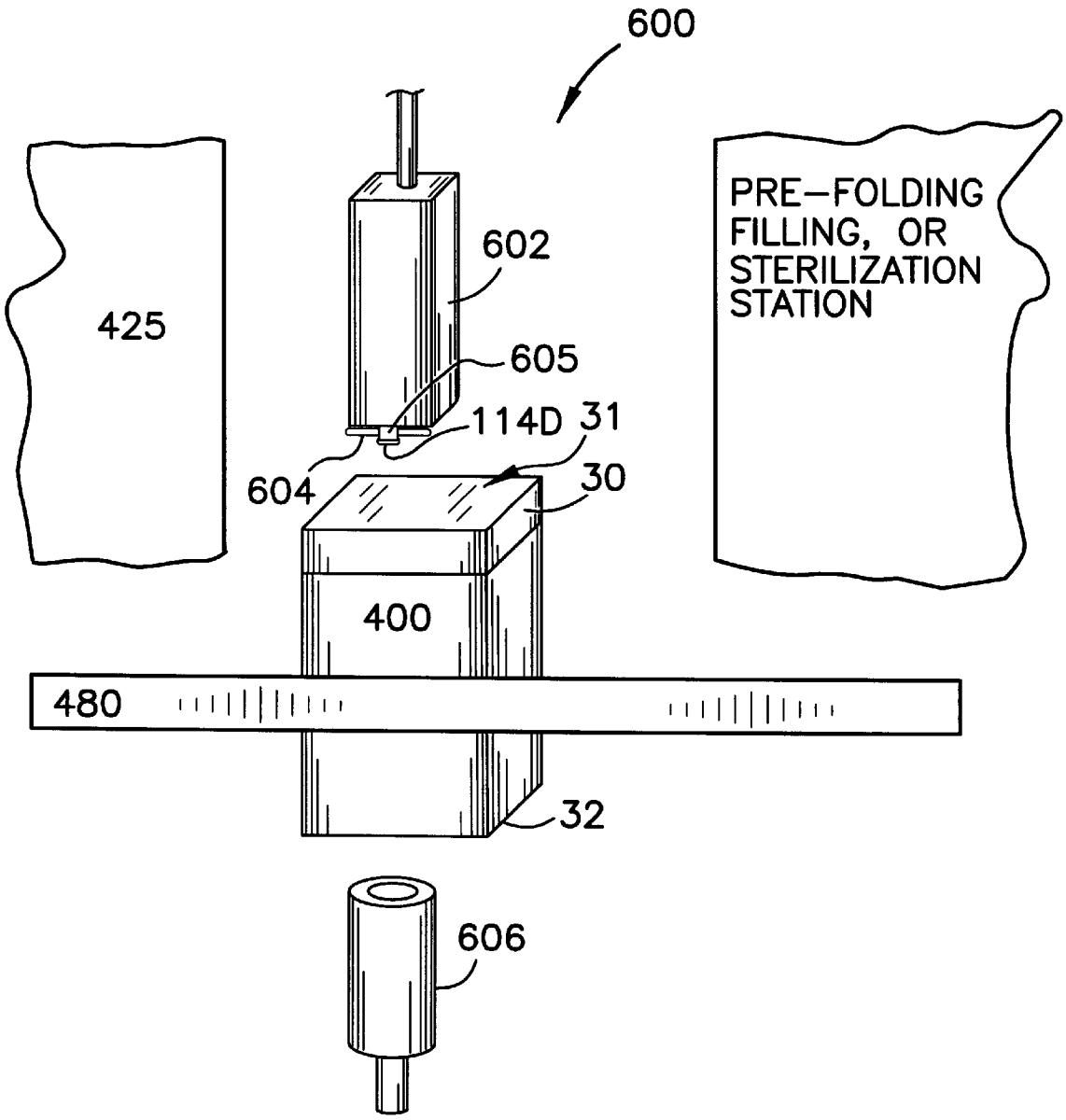

There is illustrated in FIG. 12 a schematic view of a fitment applicator of the present invention.

DETAILED DESCRIPTION OF THE INVENTION

The present invention may be practiced to fabricate a variety of containers used to package flowable materials such as milk, juice and soup. One such container is described in copending U.S. patent application Ser. No. 08/639,162 for a Flat Top Container With An Opening Fitment filed on Apr. 25, 1996 which is hereby incorporated by reference. Another such container is described in copending U.S. patent application Ser. No. 08/911,448 for a Tetrahedral Top Carton filed on Aug. 14, 1997 which pertinent parts are hereby incorporated by reference. However, those skilled in the pertinent art will recognize that other containers may be fabricated without departing from the scope and spirit of the present invention.

The novelty of the present invention is the forming and sealing of the top end of a container prior to filling and bottom sealing in such a way as to fabricate the novel containers mentioned above. The present invention involves much more than simply switching the top for the bottom. As will be described below, the sealing of the top end first provides numerous opportunities, however, it also necessitates numerous modifications to ensure that the container is sealed as tightly as a bottom first sealed container.

As shown in FIGS. 1 and 2, flat package blanks 400, which have not yet been erected, are discharged from a magazine 405 while simultaneously package blanks 400 are erected in a tubular form, which as shown is a square cross-section, however, containers having other cross-sections such as octagonal or hexagonal cross-sections are well-within the scope of the present invention. By means of feeder device 410, which, in the present embodiment, is a rotatable chain provided with carriers 415, the erected package blanks 400 are pushed onto a mandrel 420 provided on the mandrel wheel 425, the mandrel having been moved in a position opposite the feeder device 410 (in the drawing this position is designated I). Once the blank 400 has been pushed onto mandrel 420, the mandrel wheel 425 is indexed in a counter-clockwise direction until it reaches position II, whereupon the mandrel stops again. The mandrel wheel is indexed to move at a predetermined interval which usually corresponds to slowest procedure on a packaging machine. Generally, the slowest procedure is the sealing of top of a carton which in the present invention would be the bottom.

In position II, an top end 32 of the package blank 400 mounted on mandrel 420 is centrally opposite a folding device 430 controlled by actuator 435, preferably a pneumatic cylinder. With the aid of the actuator 430, the folding device 430 is moved towards the top end sections 32 of the package blank 400, the top end section projecting from the mandrel 420, whereby flaps 437 of the folding device 430 are folded inward towards the top end sections 32 of the package blank 400 to initially fold or "break" the crease lines provided in the top end sections 32 of the package blank 400. The folding process is, however, interrupted before the wall section of the package blank 400, which forms the top, has been completely folded inward to its final position, and owing to the elasticity of the material, sections 32 of the package blank 400 which projects from the mandrel 420 reverts substantially to the position in which it was prior to the folding operation.

When the pre-folding operation is completed, the mandrel wheel 425 is again indexed and stops in position III, in which the pre-folded top end sections 32 of the package blank 400 are centrally opposite a heating device 440. The heating device 440 has hot gas, preferably heated air, flow through and blow against the top end sections 32 whereby the panels of the top end section 32, which are intended to act as sealing sections, are heated to such an extent that the thermoplastic material coating on the substrate softens. The softening temperature would vary according to the coating on the substrate. The coating may be polyethylene (PE), polyethyleneterphthalate (PET), ethylene vinyl alcohol (EVOH), polypropylene (PP), and the like.

Additionally, a fitment or a complete cap assembly may be conveyed through a tube 445 from a fitment supply. The fitment may be a screw cap, flip cap, or the like. The tube 445 and heating device 440 are moved proximate the mandrel 420 and guides the fitment between open panels at the top end 32. The fitment engages the mandrel 420 and is held fast thereto by, for example, a vacuum device or the like. The tube 445 is then moved from proximate the mandrel 420 to allow the mandrel 420 with the corresponding fitment secured thereto to be indexed and rotated to position IV.

While the mandrel wheel 425 with mandrel 420 rotates from position III to position IV, section 32 of package blank 400 projecting from the mandrel 420 comes into contact with a folder 460 which folds the top end sections 32. At position IV, the panels of the to end section are heat sealed together and to the flange of a fitment 114 if so provided. A cooled pressure die 465, which may be displaced by an actuator 470, preferably a pneumatic cylinder, is pressed against the folded and sealed top section whereby the top of the container is formed. The projecting end 421 of the mandrel 420 illustrated in FIG. 1A may be flat for forming a flat top container as shown in FIG. 9. Alternatively, as shown in FIG. 1B, the top or projecting end 421 of the mandrel 420 may have a tetrahedral top for forming the container shown in FIG. 10. Those skilled in the pertinent art will recognize that other shapes are within the scope and spirit of the present invention. Also, press die 465 will have a reciprocal shape for mating with the shape, or contour, of the projecting end of the mandrel 420. Further, if the container has a fitment attached thereto, then the press die 465 will have a recess therein for receiving the fitment during the pressing of the top end 32. By cooling the heated parts of the end sections 32 simultaneously as the sections are pressed together by the pressure plate 465 and the projection end of the mandrel 420, the heated thermoplastic material layer is caused to stiffen once the heated faces have been combined by surface fusion whereby sections forming the top are held together in the compressed position so as to form a leakage proof top. In order to ensure a good seal, it is important that the folded top sections are pressed against one another with sufficient force such as several tons, since pressures of this magnitude cause effective flow of the plastic in the sealing zone and closure of any leakage channels which may occur when overlapping layers of material are joined together.

Once the top has been pressed, the mandrel wheel is indexed yet another time. In the present embodiment, the mandrel wheel 425 is indexed to position V for which no operation is provided. However, in an alternative embodiment, position V may be utilized to affix a fitment to the exterior surface of the sealed top end 32 of the package blank 400. Such application of a fitment may be through use of hot melt or ultrasonic welding using the mandrel 420 as the anvil. Also, the present embodiment demonstrates a six position rotation of the mandrel wheel 425, however those skilled in the art will recognize that greater or lesser positions may be utilized in practicing the present invention.

At position VI, the partially-formed container 400 is pulled from the mandrel 420 by means of a discharge device 470 which is vertically displaceable and has at its front part a suction or gripping device the grips the partially formed container 400. The discharging operation is effected by raising the discharging device 470 with the aid of an actuator 475 until its suction or gripping head 480 comes into contact with the top of the partially formed container 400. When the discharge device 470 moves downward, the partially-formed container 400 is pulled from the mandrel 420 and lowered between the retaining devices which are arranged on an intermittently movable chain conveyor 485. The conveyor chain transports the partially-formed containers from the mandrel wheel 425 to other stations on the form, fill and seal packaging machine. The partially formed containers are transported in an inverted state at predetermined intervals. The mandrel wheel 425 is indexed after completion to the discharge operation at position VI to position I for reception of a new package blank 400 from the feeder device 410.

As shown in FIG. 1, two or more mandrel wheels 425 are simultaneously associated with a conveyor 485, thus discharging two or more partially-formed containers 400 to the conveyor 485 for transport to further stations for processing. This necessitates further duplication of all of the processes downline such as two filling stations, two bottom sealers, and if necessary two sterilization chambers (which would be placed prior to the filling stations). Also, movement of the conveyor would be indexed to two container lengths, or if more containers are placed on the conveyor simultaneously, then the conveyor would be indexed to that number of container lengths.

Each conveyor 485 has two parallel endless chains which are provided with retaining devices 490 whereby the retaining devices located centrally opposite one another on the two chains form between them a space 495 which is so designed that an inverted container 400 may be placed within it once discharged from the mandrel wheel. The movement of the conveyor is of course synchronized with that of the mandrel wheel allowing for "fresh" empty spaces 495 to receive new partially-formed containers 400 being discharged from the mandrel wheel 425.

In one embodiment shown in FIG. 2A, once the partially-formed containers 400 are discharged to the conveyor 485 the containers 400 are sterilized at a sterilization station 486 before filling. Several examples of sterilization stations are set forth in U.S. Pat. No. 5,433,920 and copending U.S. patent application Ser. No. 08/911,967 filed on Aug. 15, 1997 for an UV Radiation And Vapor-Phase Hydrogen Peroxide Sterilization Of Packaging which relevant parts are hereby incorporated by reference.

Another embodiment shown in FIG. 2B may have a fitment applicator positioned prior to the pre-folding and filling station, and even prior to a sterilization station. The fitment applicator 487 may attach a fitment to the interior surface of the top end, or to the exterior surface of the top end via hot melt, hot air, ultrasonic welding or the like for both attachment positions. For the present invention, fitment is defined as a spout assembly, cap assembly or other device which allows for the access to the product in a container without tearing open the container.

Yet another embodiment may have the inverted partially-formed containers proceed to a prefolding station for the bottom panels, and then to a filling station. As shown in FIG. 2C, the bottom end sections 30 of the inverted partially-formed container 400 are pre-folded by means of a folding device 505 attached to a yoke 510 which may be raised and lowered. The folding has only the purpose of bending or "breaking" the crease line pattern which has been provided on the package blank and which is intended to define the folding pattern necessary for sealing the bottom of the container.

After indexing of the mandrel wheel 425 and displacement of the conveyor 485 by one stage, the pre-folded inverted partially-formed containers 400 are conveyed to the next station. In FIGS. 2A and 2C, the next station is the filling station 515 wherein a filling device fills each inverted partially-formed container from the open bottom. The inverted containers 400 may be raised about the filling tubes 520 by a lifting mechanism and gradually lowered as the container is filled. In FIG. 2B, the next station is the pre-folding station followed by the filling station 515.

Next, the filled containers are conveyed to a heating station where the bottom end sections 30 are disposed directly below a heating device 525. The heating device 525 consists of a pair of plates having a plurality of holes therein whereby heated air is blown through the holes which are arranged in a pattern which directs the heat air to primarily only those parts of the bottom end sections 30 which are intended to be sealed against one another. The coating layer (whether PE, PET, EVOH, PP or the like) is heated to the point of plastification whereupon the containers 400 are conveyed to a sealing station where the bottom end sections 30 are finally folded and sealed to form a fully fabricated container 400. The containers 400 are then discharged from the machine, or inverted then discharged for subsequent transport and distribution.

FIGS. 3–5 illustrate one manner in which the top end panels 32 of the containers 400 may be heat sealed about the fitment. The fitment 114 is introduced at position III and heating of the top sections 32 will also occur at the position III. The fitment 114 may be introduced as shown whereby a linear actuator 560 is connected to drive the tube 445 between a first position in which the end 565 of the tube 445 including a heat deflector 570 are clear of the mandrel 420 and the top end panels 32 extending from the mandrel 420, and a second position in which the end tube 565 of tube 445 is disposed proximate a central portion of the mandrel 420 corresponding to the position at which the fitment 114 will be secured to the container 400. When disposed in the second position, the fitment 114 is conveyed through the tube 445 by air, gravity, vacuum, or the like, to cover the opening of a central vacuum channel 575 that is connected to a vacuum source (not shown). The vacuum channel 575 assists in securing the fitment to the mandrel 420 while the top of the container 400 is folded and heat sealed about the fitment 114.

The heating of the top end panels 32 is shown in FIG. 5 where the top end panels 32 are presented to a heating system 580 that provides a hot, sterile gas, such as heated air, through a plurality of apertures 585 disposed at positions selected to direct the heated gas to portions of the top end panels 32 that will be sealed to one another. The heated gas is provided at a sufficient temperature, as discussed previously, to plasticize the coating layers that are used to heat seal the container 400 over the dwell time that the fitment 114 is conveyed into position for sealing to the container 400. The fitment 114, preferably formed from a polymer material, is advantageously protected from the heated gas by the tube 445 and the heat deflector 570.

As the containers 400 are indexed from position III to position IV, the top end panels 32 are folded by the folding mechanism 460 before reaching the cooled pressure die 465. On embodiment is set forth in FIGS. 6–8. Further detail concerning the folding mechanism may be found in U.S. Pat. No. 3,820,303 which pertinent parts are hereby incorporated by reference.

An example of a container fabricated using the present invention is illustrated in FIG. 9. The flat top container 400A has a fitment 114A thereon inserted through a cut-out designed on the blank for container 400A. Although, this cut-out was circular, other cut-outs may be square octagonal or the like, as long as a fitment may be inserted therethrough. Further, a perforation may be made in the blank instead of the cut-out which would allow for the attachment of the fitment 114A on the exterior surface of the top section 32A. Another example of a container fabricated using the present invention is illustrated in FIG. 10. In FIG. 10, a tetrahedral top container 400B is shown with a fitment 114B thereon. The fitment 114B may also be attached through a cut-out or attached to the exterior surface.

As shown in FIG. 11, a flip-cap fitment 114C is attached to the exterior surface 32A of the top end 32 of the container 400. The flip cap fitment 114C may be applied through hot melt, hot air, ultrasonic welding or the like. The container 400 may have a perforation 407 disposed at the attachment position of the fitment 114C to allow for access to the product. The flip-cap fitment 114C has a flange 604 for attachment to the exterior surface 32A. Although the perforation 407 is shown as an indentation of the interior surface 32B of the top end section 32, other embodiments may have the perforation on the exterior surface 32A or have an membrane composed of aluminum as a means for maintaining the integrity of the container 400.

An alternative fitment attachment means is illustrated in FIG. 12. The fitment application station 600 is disposed downline from the mandrel wheel 425 and prior to the filling stations and the sterilization station. As an inverted partially-formed container 400 is indexed to the station 600, an anvil 602 with a lobe 605 having a fitment 114D attached thereon. The anvil 602 enters the interior of the container 400 through the opening 31 at the bottom end section 30. The anvil 602 inserts the fitment 114D through a cut-out in the top end sections 32 of the container 400. The flanges 604 of the fitment 114D engage the interior surface 32B of the top end sections 32 of the container 400. Synchronized with the movement of the anvil 602, an ultrasonic horn 606 approaches toward the anvil 602 from the exterior 32A of the top end section 32. The horn 606 engages with the anvil 602 having the fitment 114D thereon thereby welding the flange 604 of the fitment 114D to the interior surface 32B of the top end section 32. The anvil 602 and horn 606 disengage, the anvil 602 ascends from the container 400, and the container 400 is indexed to the next station.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A method for fabricating a carton from a blank on a form, fill and seal packaging machine, the carton having a plurality of side panels, a top end defined by a plurality of top panels and a bottom end defined by a plurality of bottom panels, the plurality of top panels having a cut-out therein for placement of a fitment thereabout, each of the panels having interior and exterior surfaces, the method comprising:

erecting on a carton blank;

placing the erected carton blank on a mandrel projecting outward from a mandrel wheel, the mandrel wheel rotating about a fixed axis to temporarily position the mandrel at a plurality of stations disposed about the mandrel wheel, the mandrel having a body and a projection end having a predetermined contour, the mandrel attached to the mandrel wheel on an end opposite the projection end, and the mandrel having means for temporarily holding a fitment on the projection end, the plurality of top panels extending from the projection end;

folding the plurality of top panels along a plurality of crease lines defining the top panels from the side panels;

supplying a fitment to the projection end;

applying the fitment to the projection end of the mandrel, the fitment having a spout and a flange with exterior and interior surfaces;

heating the plurality of top panels and the exterior surface of the flange of the fitment at a heating station;

sealing each of the plurality of the top panels to each adjacent top panel and simultaneously sealing the exterior flange of the fitment to at least one of the plurality of top panels, the sealing occurring at a sealing station subsequent to the heating station, the top panels forming the top end of the carton, the top end of the container conforming to the contour of the projection end.

2. The method according to claim 1 further comprising discharging the carton from the mandrel subsequent to sealing the fitment to the at least one top panel, the carton discharged to a conveyor means for further processing.

3. The method according to claim 1 further comprising heating the top panels prior to sealing the top panels.

4. The method according to claim 1 wherein the top end of the carton is substantially flat.

5. The method according to claim 1 wherein the top end of the carton is a tetrahedral.

6. The method according to claim 1 further comprising delivering a fitment from a tube to engagement with the mandrel, the fitment held on the mandrel through a vacuum.

7. The method according to claim 2 wherein the carton is filled with a desired product and the bottom of the partially-formed container is sealed.

8. The method according to claim 1 wherein the carton is a paperboard material coated on both the interior and exterior surface with a material selected from the group consisting of polyethylene, polyethylene terphthalate, polypropylene and ethylene vinyl alcohol.

9. The method according to claim 1 wherein the fitment is selected from the group consisting of flip cap, screw cap, push-in cap and pull-tab cap.

10. The method according to claim 1 wherein the top end has a square cut-out.

11. The method according to claim 1 wherein the top end has a circular cut-out.

12. A method for fabricating a carton from a blank on a form, fill and seal packaging machine, the carton having a plurality of side panels, a top end defined by a plurality of top panels and a bottom end defined by a plurality of bottom panels, the plurality of top panels having a cut-out therein for placement of a fitment therethrough, each of the panels having interior and exterior surfaces, the method comprising:

erecting a carton blank;

placing an erected carton blank on a mandrel projecting outward from a mandrel wheel, the mandrel wheel rotating about a fixed axis to temporarily position the mandrel at a plurality of stations disposed about the mandrel wheel, the mandrel having a body and a projection end having a predetermined contour, the projection end opposite an end of the mandrel attached to the mandrel wheel and the mandrel having means for temporarily holding a fitment on the projection end, the plurality of top panels extending from the projection end;

heating each of the plurality of top panels at a heating station;

sealing each of the plurality of the top panels to each adjacent top panel, the top panels forming the top end of the carton, the top end of the container conforming to the contour of the projection end;

supplying a fitment to a fitment applicator station disposed on the mandrel wheel; and attaching the fitment to the carton about the cut-out by attaching the interior surface of the flange of the fitment to the exterior surface of at least one of the plurality of top panels while the carton is on the mandrel at the fitment applicator.

13. A method for fabricating a carton from a blank on a form, fill and seal packaging machine, the carton having a plurality of side panels, a top end defined by a plurality of top panels and a bottom end defined by a plurality of bottom panels, the plurality of top panels having a cut-out therein for placement of a fitment therethrough, each of the panels having interior and exterior surfaces, the method comprising:

erecting a carton blank;

placing an erected carton blank on a mandrel projecting outward from a mandrel wheel, the mandrel wheel rotating about a fixed axis to temporarily position the mandrel at a plurality of stations disposed about the mandrel wheel, the mandrel having a body and a projection end having a predetermined contour, the projection end opposite an end of the mandrel attached to the mandrel wheel and the mandrel having means for temporarily holding a fitment on the projection end, the plurality of top panels extending from the projection end;

heating each of the plurality of top panels at a heating station;

sealing each of the plurality of the top panels to each adjacent top panel, the top panels forming the top end of the carton, the top end of the container conforming to the contour of the projection end;

discharging the carton from the mandrel to placing the carton on a conveyor;

supplying a fitment to an anvil;

attaching the fitment to the carton subsequent to discharging the carton from the mandrel and placing the carton on a conveyor and prior to filling the carton with a product, the fitment attached to the carton by placing the anvil with the fitment thereon into the interior of the carton through the open bottom end and ultrasonically welding the exterior surface of the flange of the fitment to the interior surface of at least one of the plurality of top panels.

* * * * *